US011133129B2

(12) United States Patent
Lee et al.

(10) Patent No.: US 11,133,129 B2
(45) Date of Patent: Sep. 28, 2021

(54) COIL COMPONENT

(71) Applicant: SAMSUNG ELECTRO-MECHANICS CO., LTD., Suwon-si (KR)

(72) Inventors: Young Il Lee, Suwon-Si (KR); Byeong Cheol Moon, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 327 days.

(21) Appl. No.: 16/175,746

(22) Filed: Oct. 30, 2018

(65) Prior Publication Data

US 2019/0333679 A1 Oct. 31, 2019

(30) Foreign Application Priority Data

Apr. 25, 2018 (KR) ..... 10-2018-0047655

(51) Int. Cl.
*H01F 5/00* (2006.01)
*H01F 27/28* (2006.01)
(Continued)

(52) U.S. Cl.
CPC ..... *H01F 27/2804* (2013.01); *H01F 27/292* (2013.01); *H01F 27/327* (2013.01); *H01F 2027/2809* (2013.01)

(58) Field of Classification Search
CPC ..... H01F 2027/2809
(Continued)

(56) References Cited

U.S. PATENT DOCUMENTS 6,084,500 A * 7/2000 Kanetaka ..... H01F 41/041 336/223
2016/0268038 A1 9/2016 Choi
(Continued)

FOREIGN PATENT DOCUMENTS

CN 104700991 A 6/2015
CN 105957692 A 9/2016
(Continued)

OTHER PUBLICATIONS

Chinese Office Action dated Feb. 10, 2021 issued in Chinese Patent Application No. 201910055990.1 (with English translation)
(Continued)

*Primary Examiner* — Ronald Hinson
(74) *Attorney, Agent, or Firm* — Morgan, Lewis & Bockius LLP

(57) ABSTRACT

A coil electronic component includes a body including an internal coil including first and second end portions, and an encapsulant surrounding the internal coil and formed of a magnetic material, and first and second external electrodes disposed on external surfaces of the body. The body includes a first surface and a second surface to which the first and second end portions are led, respectively, and which oppose each other, a third surface connecting the first and second surfaces to each other and perpendicular to a center of a core of the internal coil, and a fourth surface opposing the third surface, and a first corner connecting the first surface and the third surface to each other and a second corner connecting the second surface and the third surface to each other include first and second recess portions, respectively.

22 Claims, 3 Drawing Sheets

(51) Int. Cl.
*H01F 27/32* (2006.01)
*H01F 27/29* (2006.01)

(58) Field of Classification Search
USPC ..... 336/200
See application file for complete search history.

(56) References Cited

U.S. PATENT DOCUMENTS

| | | | | |
|---|---|---|---|---|
| 2017/0133146 | A1 | 5/2017 | Lee | |
| 2017/0207018 | A1 | 7/2017 | Jung | |
| 2017/0309389 | A1 | 10/2017 | Sato et al. | |
| 2018/0096783 | A1* | 4/2018 | Fukuda | H01F 17/04 |
| 2019/0189338 | A1 | 6/2019 | Kim et al. | |

FOREIGN PATENT DOCUMENTS

| | | | |
|---|---|---|---|
| CN | 107331508 | A | 11/2017 |
| KR | 10-1999-0066108 | A | 8/1999 |
| KR | 10-0509684 | A | 8/2005 |
| KR | 10-2017-0086802 | A | 7/2017 |
| WO | 2018/048135 | A1 | 3/2018 |

OTHER PUBLICATIONS

Second Office Action issued in corresponding Chinese Patent Application No. 201910055990.1 dated Aug. 4, 2021, with English translation.

* cited by examiner

COIL COMPONENT

CROSS-REFERENCE TO RELATED APPLICATION(S)

This application claims benefit of priority to Korean Patent Application No. 10-2018-0047655 filed on Apr. 25, 2018 in the Korean Intellectual Property Office, the disclosure of which is incorporated herein by reference in its entirety.

TECHNICAL FIELD

The present disclosure relates to a coil electronic component, and more particularly, to a power inductor.

BACKGROUND

In recent years, as portable electronic devices such as CPUs for PCs, smartphones, tablet PCs, and the like, have been multifunctionalized, have been provided with high-performance, have been miniaturization and made lightweight, electronic components used therein are necessarily required to have characteristics of high performance, miniaturization/lightweightedness/thinness, and multifunctional integration. The development of miniaturization and thinning of power inductors, mainly used in a direct current (DC)-DC converter in a power supply terminal of a portable device, is continuously required.

SUMMARY

An aspect of the present disclosure may provide a coil electronic component capable of miniaturizing a chip size through a low-profile coil electronic component and increasing capacity by significantly increasing the content of a magnetic material contained in the coil electronic component.

According to an aspect of the present disclosure, a coil electronic component may include a body including an internal coil including first and second end portions, and an encapsulant surrounding the internal coil and formed of a magnetic material; and first and second external electrodes disposed on external surfaces of the body and connected to the first and second end portions of the internal coil, respectively. The body may include a first surface and a second surface to which the first and second end portions are led, respectively, and which oppose each other, a third surface connecting the first and second surfaces to each other and being perpendicular to a center of a core of the internal coil, and a fourth surface opposing the third surface, a first corner connecting the first surface and the third surface to each other and a second corner connecting the second surface and the third surface to each other may include first and second recess portions, respectively, first and second insulating layers may be disposed on the third surface and the fourth surface, respectively, the first and second external electrodes may extend to the first and second recess portions, respectively, and a maximum thickness of the coil electronic component may be a distance between a lower surface of the first insulating layer and an upper surface of the second insulating layer.

Each of the first and second external electrodes may include a first electrode layer which is directly connected to the first and second end portions, a second electrode layer surrounding the first electrode layer, and a third electrode layer surrounding the second electrode layer.

The first electrode layer may be formed of the same material as that of the internal coil.

The second and third electrode layers may be a nickel (Ni) layer and a tin (Sn) layer, respectively.

The first and second insulating layers may be in the form of a film.

The first and second insulating layers may include a curable resin.

A thickness of the first insulating layer may be less than that of the second insulating layer.

The body may further include a fifth surface and a sixth surface opposing each other and parallel to the center of the core of the internal coil, and the coil electronic component may further include third and fourth insulating layers disposed on the fifth and sixth surfaces, respectively.

A thickness deviation of each of the third and fourth insulating layers may be greater than that of each of the first and second insulating layers.

The shortest distance between the first and second recess portions may be equal to a length of the first insulating layer.

A side surface of each of the first and second recess portions may be formed on the same line as the innermost surface of the internal coil.

A third corner connecting the first surface and the fourth surface to each other and a fourth corner connecting the second surface and the fourth surface to each other may further include third and fourth recess portions, respectively.

The first external electrode may be continuously disposed from the first recess portion to the third recess portion, and the second external electrode may be continuously disposed from the second recess portion to the fourth recess portion.

The shortest distance the third and fourth recess portions may be equal to a length of the second insulating layer.

The body may have a maximum thickness along the center of the core of the internal coil.

A side surface of each of the first and second recess portions may be disposed on the same line as the innermost side surface of the internal coil.

A side surface of each of the third and fourth recess portions may be disposed on the same line as the innermost side surface of the internal coil.

A thickness of the first insulating layer may be substantially the same as that of the second insulating layer.

According to an aspect of the present disclosure, a coil electronic component may include a body including an internal coil including first and second end portions, and an encapsulant surrounding the internal coil and formed of a magnetic material; and first and second external electrodes disposed on external surfaces of the body and connected to the first and second end portions of the internal coil, respectively. The body may include a first surface and a second surface to which the first and second end portions are led, respectively, and which oppose each other, a third surface connecting the first and second surfaces to each other. A first corner connecting the first surface and the third surface to each other and a second corner connecting the second surface and the third surface to each other may include first and second recess portions, respectively. The first external electrode may extend from the first surface to the first recess portion, and the second external electrode may extend from the second surface to the second recess portion. First and second insulating layers may be disposed on the third surface and the fourth surface, respectively. The first insulating layer may protrude with respect to an extending portion of the first external electrode to the first recess portion and an extending portion of the second external electrode to the second recess portion.

The body may further include a fifth surface and a sixth surface opposing each other, and the coil electronic component may further include third and fourth insulating layers disposed on the fifth and sixth surfaces, respectively. A thickness deviation of each of the third and fourth insulating layers may be greater than that of each of the first and second insulating layers.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Figure 1:
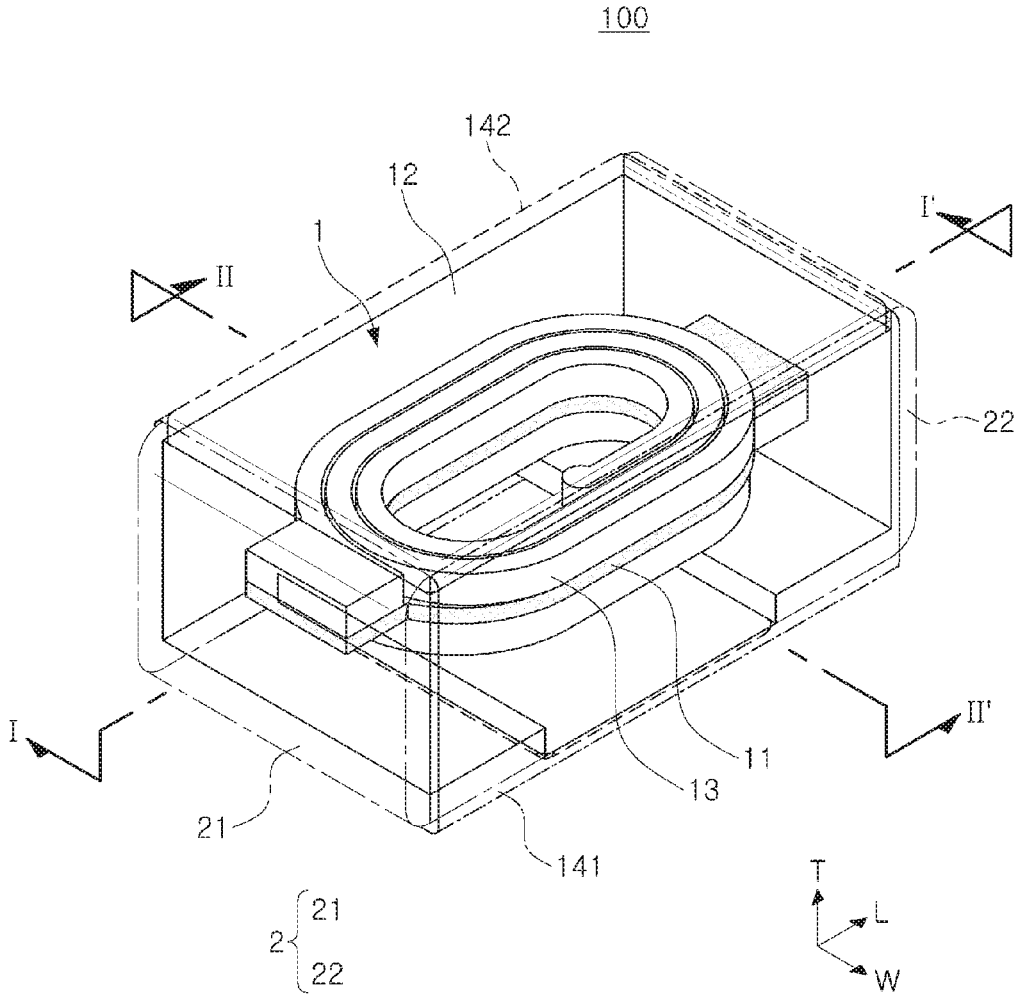
FIG. 1 is a schematic perspective view illustrating a coil electronic component according to an exemplary embodiment in the present disclosure.
Figure 2:
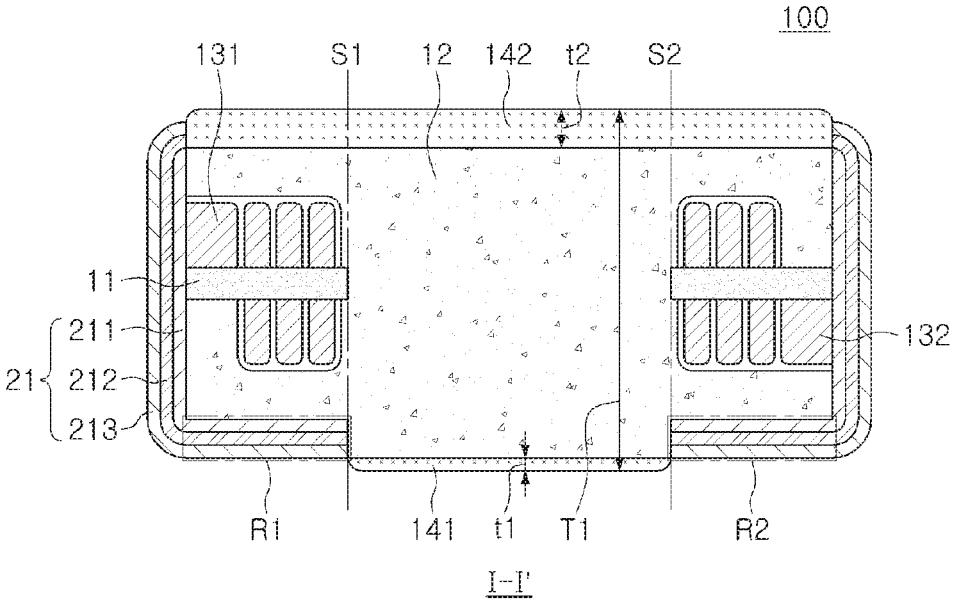
FIG. 2 is a cross-sectional view taken along a line I-I' of FIG. 1.
Figure 3:
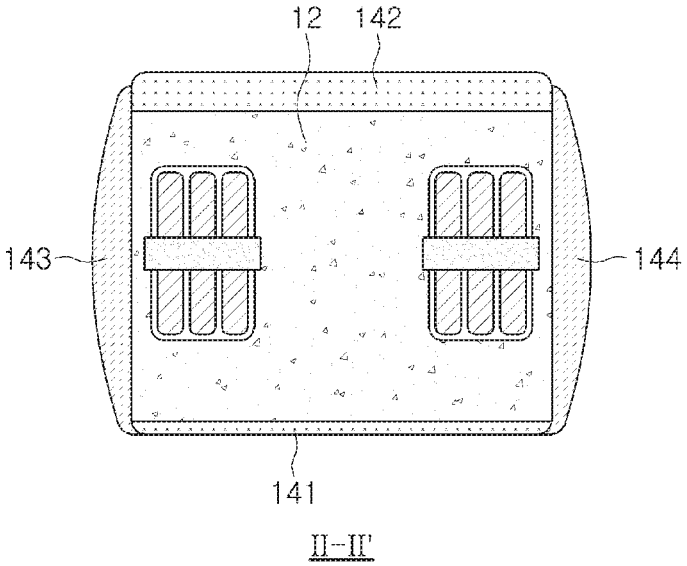
FIG. 3 is a cross-sectional view taken along line II-II' of FIG. 1.

FIG. 1 is a schematic perspective view illustrating a coil electronic component according to an exemplary embodiment in the present disclosure, FIG. 2 is a cross-sectional view taken along a line I-I' of FIG. 1, and FIG. 3 is a cross-sectional view taken along line II-II' of FIG. 1.

Referring to FIGS. 1 through 3, a coil electronic component 100 may include a body 1 and external electrodes 2 disposed on external surfaces of the body.

The body 1 may include a first surface and a second surface opposing each other in a length direction L of the body 1, a third surface and a fourth surface opposing each other in a thickness direction T of the body 1, and a fifth surface and a sixth surface opposing each other in a width direction W of the body 1, and have substantially a hexahedral shape.

The body 1 may include an encapsulant 12 and the encapsulant 12 may determine an entire outer shape of the body. The encapsulant 12 may encapsulate a support member and an internal coil to be described below. The encapsulant 12 may have a magnetic property and may include a magnetic material and a resin. The magnetic material may be applied without limitation as long as it has the magnetic property, and may be, for example, a ferrite or a metal magnetic particle. In this case, the metal magnetic particle may include iron (Fe), chromium (Cr), aluminum (Al), nickel (Ni), silicon (Si), boron (B), niobium (Nb), or the like, but is not limited thereto.

Referring to FIG. 2, first and second end portions 131 and 132 of the internal coil may be exposed to the first and second surfaces, respectively. The third and fourth surfaces, which are substantially a lower surface and an upper surface of the body, may be disposed to be perpendicular to the center of a core formed from the internal coil.

A first insulating layer 141 and a second insulating layer 142 may be disposed on the third and fourth surface of the body, respectively. The first and second insulating layers 141 and 142 may have the form of a film. Since the first and second insulating layers are formed by pressing and curing an insulating film exhibiting insulating property instead of forming the first and second insulating layers through a normal printing method, processes such as printing, curing, and the like may be omitted and mass productivity may be increased. In addition, a problem of a decrease in reliability due to uneven printing (deviation of an insulation thickness) inevitably generated when the printing method is applied may be prevented. In a case in which the insulating layer for insulating the surfaces of the body is non-uniform, insulation reliability in the vicinity of the insulating layer formed to be relatively thin may be reduced. As a result, when the external electrodes are formed, a problem such as plating bleeding or the like may be caused.

However, in the coil electronic component according to the present disclosure, since the insulating layer for insulating the surfaces of the body is formed by stacking, pressing, and curing the insulating film, the formation of a substantially uniform insulating layer may be completely ensured. In addition, a thickness of the insulating layer may be accurately controlled, such that a thin film insulating layer having the thickness of 10 μm or less may be provided. The first and second insulating layers may preferably include a curable resin. The reason is because the upper surface and the lower surface of the body may be insulated through a simple curing process.

The body may include first and second recess portions R1 and R2 in both end portions of the third surface of the body in the length direction of the body. The first and second recess portions refer to spaces formed by removing a portion of the encapsulant in the body.

The first recess portion R1 may be the space formed in a corner connecting the first surface and the third surface of the body to each other, and the second recess portion R2 may be the space formed in a corner connecting the second surface and the third surface of the body to each other.

A first external electrode 21 and a second external electrode 22 may extend to the first and second recess portions R1 and R2, respectively.

When the first external electrode is disposed on the first surface of the body and is connected to a first end portion of the internal coil exposed to the first surface of the body, the first external electrode may extend from the first surface of the body to the first recess portion R1. Similarly, when the second external electrode is disposed on the second surface of the body and is connected to a second end portion of the internal coil exposed to the second surface of the body, the second external electrode may extend from the second surface of the body to the second recess portion R2.

When the first and second external electrodes extend onto the third surface of the body to configure an L-shaped external electrode structure, the first and second external electrodes may extend to the first and second recess portions, respectively. Therefore, a total thickness of the coil electronic component may be maintained at a level of a total thickness of the body. In other words, the maximum thickness of the coil electronic component refers to a distance T1 from a lower surface of the first insulating layer 141 to an upper surface of the second insulating layer 142, and may not exceed T1. As such, since the maximum thickness of the coil electronic component may be controlled at the level of the total thickness of only the body, a final thickness of the coil electronic component may be reduced.

When the first and second external electrodes are formed, a plurality of times of plating may be required. Lower portions of the first and second external electrodes may not protrude from the surfaces of the body due to the first and second recess portions.

In addition, a thickness t1 of the first insulating layer 141 may be less than a thickness t2 of the second insulating layer 142 in order to prevent an occurrence of over-plating in the vicinity of the first and second recess portions R1 and R2 when the first and second external electrodes 21 and 22 are formed. By forming the thicknesses of the first and second insulating layers 141 and 142 asymmetrically, the total thickness of the body may be significantly reduced and a phenomenon in which a portion of the first and second external electrodes is over-plated on the upper surface of the first insulating layer may be prevented.

Referring to FIG. 2, the respective side surfaces of the first and second recess portions may be disposed on the same lines S1 and S2 as the innermost side surface of the internal coil, or may be disposed to be closer to an external surface (i.e., the surface(s) in the length direction) of the body than the same lines S1 and S2 as the innermost side surface of the internal coil. In this case, a volume of the center of the core of the internal coil may be sufficiently secured, so that a reduction in capacity due to the first and second recess portions may be significantly reduced. The capacity of the coil electronic components may be greatly affected by the encapsulant filled in the core of the internal coil. According to the above structure, even when a portion of the body is substantially removed, the capacity may not be substantially changed. In addition, in the case in which the respective side surfaces of the first and second recess portions are disposed to closer to the external surface of the body than the same lines S1 and S2, in other words, in a case in which a length of the body is reduced in relation to the length direction of the body, an over-growth of the external electrodes may be more effectively prevented.

The body 1 may include a support member 11 and the support member 11 may serve to easily form the internal coil 13 and to support the internal coil 13. The support member 11 may be formed of a thin plate having insulation property, and may be formed of, for example, a thermosetting resin such as an epoxy resin, a thermoplastic resin such as polyimide, or a resin having a reinforcement material such as a glass fiber or an inorganic filler impregnated the thermosetting resin and the thermoplastic resin. Specifically, a known copper clad lamination (CCL) substrate, an Ajinomoto Build-up Film (ABF) film, FR-4, a Bismaleimide Triazine (BT) resin, a PID resin, or the like may be used.

The support member 11 may include a through-hole and a via hole. The through-hole may be substantially formed in a central portion of the support member and the via hole may be spaced apart from the through-hole by a predetermined distance. The through-hole may be filled with the encapsulant 12 formed of a magnetic material to serve to increase magnetic permeability of the coil component. On the basis of the above description, when a cross-sectional area of the through-hole is increased, the magnetic permeability may be increased.

The internal coil 13 may be supported by the support member 11 and may have a spiral shape. Both end portions of the internal coil 13 may be exposed to the first and second surfaces of the body to connect the first and second external electrodes 21 and 22 and the internal coil to each other.

The first and second external electrodes 21 and 22 may include a plurality of electrode layers. Since a description of the first external electrode may be applied to the second external electrode as it is, the description of the first external electrode is applied to the second external electrode for convenience of explanation and a detailed description of the second external electrode will be omitted.

The first external electrode 21 may include a first electrode layer 211 which is directly connected to a first end portion 131 of the internal coil 13, a second electrode layer 212 surrounding the first electrode layer, and a third electrode layer 213 surrounding the second electrode layer. This does not mean that the first external electrode includes only the first to third electrode layers and excludes an additional electrode layer.

The first electrode layer 211 may serve to increase a contact area between the internal coil and the external electrodes. The first electrode layer 211 may be formed of the same material as that of the internal coil 13. The reason is because bonding force of the same material is strong and an effect of increasing the contact area between the internal coil 13 and the external electrodes may be thus significantly increased.

The second electrode layer 212 may be a nickel (Ni) layer so that a current may smoothly flow through the external electrodes, and the third electrode layer 213 may be a tin (Sn) layer having excellent adhesion with a solder used for fixing the coil electronic component, when the coil electronic component is mounted on a substrate.

Referring to FIG. 3, third and fourth insulating layers 143 and 144 may be disposed on the fifth and sixth surfaces of the body opposing each other in the width direction of the body, unlike the first and second insulating layers disposed on the third and fourth surfaces of the body. The third and fourth insulating layers may be formed by using a screen printing method, which is a typical process of forming an insulating layer. The reason is because thicknesses of the third and fourth insulating layers are not highly related to the total thickness of the body, unlike the first and second insulating layers. As an example, in the case in which the third insulating layer is formed by the screen printing method, a central portion of the third insulating layer has a thickness of about 20 μm, while both end portions of the third insulating layer have the thickness of about 5 to 6 μm, which result in a significant thickness deviation. On the other hand, since the first insulating layer 141 is in the form of a film, the thickness deviation of the first insulating layer 141 may be substantially close to zero, and the thickness deviation of the first insulating layer 141 may be smaller than that of the third insulating layer 143 and that of the fourth insulating layer 144. Similarly, the thickness deviation of the second insulating layer 142 may be substantially close to zero, and the thickness deviation of the second insulating layer 142 may be smaller than that of the third insulating layer 143 and that of the fourth insulating layer 144.

Figure 4:
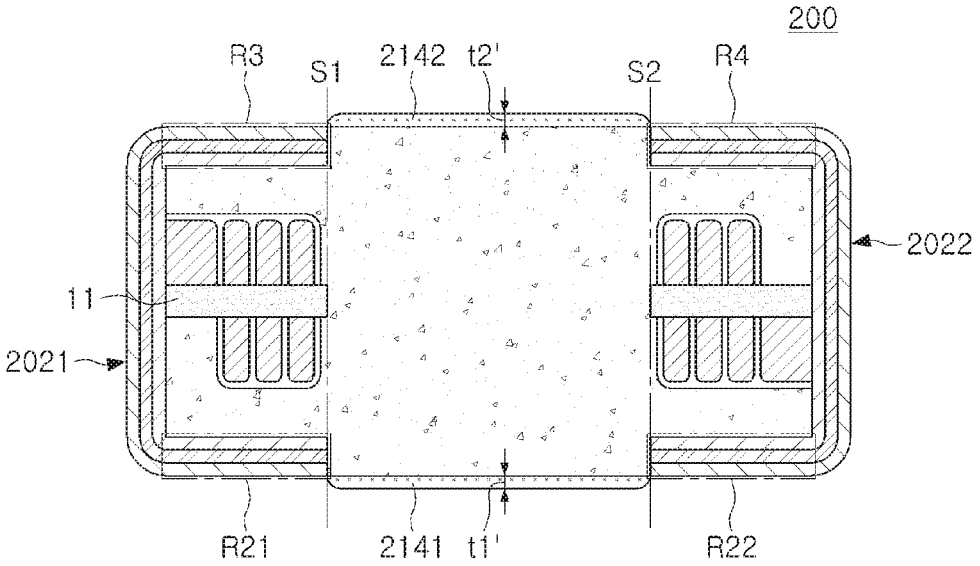
FIG. 4 is a cross-sectional view of an electronic component according to a modified example of the coil component of FIGS. 1 and 3.

FIG. 4 is a cross-sectional view of an electronic component 200 according to a modified example of the coil component 100 illustrated in FIGS. 1 through 3. For convenience of explanation, the contents overlapped with the coil electronic component 100 described above will be omitted.

Referring to FIG. 4, the coil electronic component 200 may further include third and fourth recess portions R3 and R4 in both end portions of the body in the length direction of the body. The third recess portion R3 may be formed in a corner formed between the fourth surface and the first surface of the body, and the fourth recess portion R4 may be formed in a corner formed between the fourth surface and the second surface of the body.

A first external electrode 2021 may extend from the first recess portion R21 to the third recess portion R3 to have a letter C-shaped cross section, and a second external electrode 2022 may extend from the second recess portion R22 to the fourth recess portion R4 to have a letter C-shaped cross section. Since compositions of the first and second external electrodes 2021 and 2022 may be the same as the above-described first and second external electrodes 21 and 22, the description of the compositions of the first and second external electrodes 2021 and 2022 will be omitted.

The shortest distance between the third and fourth recess portions R3 and R4 is equal to a length of a second insulating layer 2142.

A thickness t1' of the first insulating layer may be equal to a thickness t2' of the second insulating layer. This is because it is necessary to prevent over-plating of the first and second external electrodes at both ends of the first insulating layer 2141 as well as at both ends of the second insulating layer 2142.

The respective side surfaces of the third and fourth recess portions may be formed on the same lines S1 and S2 as the innermost side surface of the internal coil, or may be formed to be closer to an external surface of the body than the same lines S1 and S2. This is to significantly increase the volume of the encapsulant included in the center of the core of the internal coil and to prevent the over-plating of the external electrodes, as described in the first and second recess portions.

According to the coil electronic component described above, by making the thicknesses of the insulating layers disposed on the surfaces of the body uniform, a problem of plating bleeding of the external electrodes caused by unevenness in the thickness may be solved, and a problem of an increase in the total thickness of the chip caused by the external electrodes may be solved. Therefore, a low-profile coil electronic component having enhanced insulation reliability may be provided.

As set forth above, according to an exemplary embodiment in the present disclosure, the chip size of the coil electronic component may be reduced, and high capacity may be implemented as compared to the same size.

While exemplary embodiments have been shown and described above, it will be apparent to those skilled in the art that modifications and variations could be made without departing from the scope of the present invention as defined by the appended claims.

What is claimed is:

1. A coil electronic component comprising:

a body including an internal coil including first and second end portions, and an encapsulant surrounding the internal coil and including a magnetic material; and first and second external electrodes disposed on external surfaces of the body and connected to the first and second end portions of the internal coil, respectively, wherein the body includes a first surface and a second surface to which the first and second end portions are led, respectively, and which oppose each other in a length direction of the body, a third surface connecting the first and second surfaces to each other and being perpendicular to a center of a core of the internal coil, and a fourth surface opposing the third surface, a first corner connecting the first surface and the third surface to each other and a second corner connecting the second surface and the third surface to each other include first and second recess portions, respectively, first and second insulating layers are disposed on the third surface and the fourth surface, respectively, the first and second external electrodes extend to the first and second recess portions, respectively, a maximum thickness of the coil electronic component is a distance between a lower surface of the first insulating layer and an upper surface of the second insulating layer, and each of the first and second insulating layers is in contact with the encapsulant and is spaced apart from the internal coil.

2. The coil electronic component of claim 1, wherein a thickness of the first insulating layer is less than that of the second insulating layer.

3. The coil electronic component of claim 1, wherein the shortest distance between the first and second recess portions is equal to a length of the first insulating layer.

4. The coil electronic component of claim 1, wherein a side surface of each of the first and second recess portions is disposed on the same line as the innermost surface of the internal coil.

5. The coil electronic component of claim 1, wherein a length of first insulating layer in the length direction is less than a length of second insulating layer in the length direction.

6. The coil electronic component of claim 1, wherein each of the first and second external electrodes includes a first electrode layer which is directly connected to the first and second end portions, a second electrode layer surrounding the first electrode layer, and a third electrode layer surrounding the second electrode layer.

7. The coil electronic component of claim 6, wherein the first electrode layer includes the same material as that of the internal coil.

8. The coil electronic component of claim 6, wherein the second and third electrode layers are a nickel (Ni) layer and a tin (Sn) layer, respectively.

9. The coil electronic component of claim 1, wherein the first and second insulating layers are in the form of a film.

10. The coil electronic component of claim 9, wherein the first and second insulating layers include a curable resin.

11. The coil electronic component of claim 1, wherein the body further includes a fifth surface and a sixth surface opposing each other and parallel to the center of the core of the internal coil, and the coil electronic component further comprises third and fourth insulating layers disposed on the fifth and sixth surfaces, respectively.

12. The coil electronic component of claim 11, wherein a thickness deviation of each of the third and fourth insulating layers is greater than that of each of the first and second insulating layers.

13. The coil electronic component of claim 1, wherein a third corner connecting the first surface and the fourth surface to each other and a fourth corner connecting the second surface and the fourth surface to each other further include third and fourth recess portions, respectively.

14. The coil electronic component of claim 13, wherein the first external electrode is continuously disposed from the first recess portion to the third recess portion, and the second external electrode is continuously disposed from the second recess portion to the fourth recess portion.

15. The coil electronic component of claim 13, wherein the shortest distance between the third and fourth recess portions is equal to a length of the second insulating layer.

16. The coil electronic component of claim 13, wherein the body has a maximum thickness along the center of the core of the internal coil.

17. The coil electronic component of claim 13, wherein a side surface of each of the first and second recess portions is disposed on the same line as the innermost side surface of the internal coil, or is disposed to be closer to the external surfaces of the body than the same line.

18. The coil electronic component of claim 13, wherein a side surface of each of the third and fourth recess portions is disposed on the same line as the innermost side surface of the internal coil, or is disposed to be closer to the external surfaces of the body than the same line.

19. The coil electronic component of claim 13, wherein a thickness of the first insulating layer is substantially the same as that of the second insulating layer.

20. A coil electronic component comprising:

a body including an internal coil including first and second end portions, and an encapsulant surrounding the internal coil and including a magnetic material; and first and second external electrodes disposed on external surfaces of the body and connected to the first and second end portions of the internal coil, respectively, wherein the body includes a first surface and a second surface to which the first and second end portions are led, respectively, and which oppose each other in a length direction of the body, a third surface connecting the first and second surfaces to each other, and a fourth surface opposing the third surface, a first corner connecting the first surface and the third surface to each other and a second corner connecting the second surface and the third surface to each other include first and second recess portions, respectively, the first external electrode extends from the first surface to the first recess portion, and the second external electrode extends from the second surface to the second recess portion, first and second insulating layers are disposed on the third surface and the fourth surface, respectively, the first insulating layer protrudes with respect to an extending portion of the first external electrode to the first recess portion and an extending portion of the second external electrode to the second recess portion, and each of the first and second insulating layers is in contact with the encapsulant and is spaced apart from the internal coil.

21. The coil electronic component of claim 20, wherein the body further includes a fifth surface and a sixth surface opposing each other, the coil electronic component further comprises third and fourth insulating layers disposed on the fifth and sixth surfaces, respectively, and a thickness deviation of each of the third and fourth insulating layers is greater than that of each of the first and second insulating layers.

22. The coil electronic component of claim 20, wherein a length of first insulating layer in the length direction is less than a length of second insulating layer in the length direction.

* * * * *